US009765778B2

(12) United States Patent
Cadeddu et al.

(10) Patent No.: US 9,765,778 B2
(45) Date of Patent: Sep. 19, 2017

(54) VARIABLE DISPLACEMENT ROTARY PUMP AND DISPLACEMENT REGULATION METHOD

(71) Applicant: VHIT S.P.A., Offanengo (IT)

(72) Inventors: Leonardo Cadeddu, Offanengo (IT); Matteo Cortesi, Offanengo (IT)

(73) Assignee: VHIT S.P.A., Offanengo (CR) (IT)

( * ) Notice: Subject to any disclaimer, the term of this patent is extended or adjusted under 35 U.S.C. 154(b) by 123 days.

(21) Appl. No.: 14/386,238

(22) PCT Filed: Mar. 13, 2013

(86) PCT No.: PCT/IB2013/051974
§ 371 (c)(1),
(2) Date: Sep. 18, 2014

(87) PCT Pub. No.: WO2013/140304
PCT Pub. Date: Sep. 26, 2013

(65) Prior Publication Data

US 2015/0030485 A1 Jan. 29, 2015

(30) Foreign Application Priority Data

Mar. 19, 2012 (IT) ..... TO2012A000237
Nov. 20, 2012 (IT) ..... TO2012A001007

(51) Int. Cl.
*F03C 4/00* (2006.01)
*F04C 21/00* (2006.01)
(Continued)

(52) U.S. Cl.
CPC ..... *F04C 14/223* (2013.01); *F04C 2/3442* (2013.01); *F04C 11/006* (2013.01); *F04C 15/0042* (2013.01); *F04C 2/3441* (2013.01)

(58) Field of Classification Search
CPC ..... F04C 14/223; F04C 15/0042
(Continued)

(56) References Cited

U.S. PATENT DOCUMENTS 2,685,842 A 8/1954 Hufferd
4,778,352 A 10/1988 Nakajima
(Continued)

FOREIGN PATENT DOCUMENTS

SU 785 548 A1 12/1980
WO 00/73660 A1 12/2000

OTHER PUBLICATIONS

International Search Report for PCT/IB2013/051974 dated Jun. 6, 2013.
Written Opinion for PCT/IB2013/051974 dated Jun. 6, 2013.

*Primary Examiner* — Deming Wan
(74) *Attorney, Agent, or Firm* — Sughrue Mion, PLLC

(57) ABSTRACT

A rotary positive displacement pump for fluids, in particular for the lubrication oil of a motor vehicle engine (60), has a displacement that can be regulated by means of the rotation of a stator ring (12) having an eccentric cavity (13) in which the rotor (15) of the pump (1) rotates. The stator ring (12) is configured as a multistage rotary piston for displacement regulation and is arranged to be directly driven by a fluid under pressure, in particular oil taken from a delivery side (19) of the pump or from a point of the lubrication circuit located downstream the oil filter (62). The invention also concerns a method of regulating the displacement of the pump (1) and a lubrication system for a motor vehicle engine in which the pump (1) is used.

15 Claims, 5 Drawing Sheets

(51) Int. Cl.

| | |
|---|---|
| ***F04C 23/00*** | (2006.01) |
| ***F04C 9/00*** | (2006.01) |
| ***F04C 14/18*** | (2006.01) |
| ***F04C 28/18*** | (2006.01) |
| ***F04B 49/08*** | (2006.01) |
| ***F04C 14/22*** | (2006.01) |
| ***F04C 11/00*** | (2006.01) |
| ***F04C 15/00*** | (2006.01) |
| *F04C 2/344* | (2006.01) |

(58) Field of Classification Search
USPC ..... 418/259, 24, 29, 31, 260, 261, 26, 30; 417/220, 218
See application file for complete search history.

(56) References Cited

U.S. PATENT DOCUMENTS

| | | | | |
|---|---|---|---|---|
| 7,484,939 | B2 * | 2/2009 | Hansen | F04B 1/07 417/218 |
| 9,404,495 | B2 * | 8/2016 | Cadeddu | F04C 14/226 |
| 2009/0202375 | A1 * | 8/2009 | Shulver | F01M 1/16 418/26 |
| 2010/0232989 | A1 * | 9/2010 | Watanabe | F04C 14/226 417/364 |

* cited by examiner

VARIABLE DISPLACEMENT ROTARY PUMP AND DISPLACEMENT REGULATION METHOD

CROSS REFERENCE TO RELATED APPLICATIONS

This application is a National Stage of International Application No. PCT/IB2013/051974 filed Mar. 13, 2013, claiming priority based on Italian Patent Application Nos. TO2012A000237 filed Mar. 19, 2012 and TO2012A001007, filed Nov. 20, 2012, the contents of all of which are incorporated herein by reference in their entirety.

TECHNICAL FIELD

The present invention relates to variable displacement pumps, and more particularly it concerns a rotary positive displacement pump of the kind in which the displacement variation is obtained by means of the rotation of an eccentric ring (stator ring).

Preferably, but not exclusively, the present invention is employed in a pump for the lubrication oil of a motor vehicle engine.

PRIOR ART

It is known that, in pumps for making lubricating oil under pressure circulate in motor vehicle engines, the capacity, and hence the oil delivery rate, depends on the rotation speed of the engine. Hence, the pumps are designed so as to provide a sufficient delivery rate at low speeds, in order to ensure lubrication also under such conditions. If the pump has fixed geometry, at high rotation speed the delivery rate exceeds the necessary rate, whereby a high power absorption, and consequently a higher fuel consumption, and a greater stress of the components due to the high pressures generated in the circuit occur.

In order to obviate this drawback, it is known to provide the pumps with systems allowing a delivery rate regulation at the different operating conditions of the vehicle, in particular through a displacement regulation. Different solutions are known to this aim, which are specific for the particular kind of pumping elements (external or internal gears, vanes . . . ).

A system often used in rotary pumps employs a stator ring with an internal cavity, eccentric relative to the external surface, inside which the rotor, in particular a vane rotor, rotates, the rotor being eccentric with respect to the cavity under operating conditions of the pump. By rotating the stator ring by a given angle, the relative eccentricity between the rotor and the cavity, and hence the displacement, is made to vary between a maximum value and a minimum value, substantially tending to zero (stall operating condition). A suitably calibrated opposing resilient member allows the rotation when a predetermined delivery rate is attained and makes the pump substantially deliver such a predetermined delivery rate under steady state conditions. Pumps of this kind are disclosed in US 2685842 and WO 00/73660.

According to those documents, the rotation of the ring is obtained through a toothed wheel or a rack, which meshes with teeth provided on the external surface of the ring and is associated with a piston biased by the delivery pressure of the pump or is operated by a motor, which in turn may be driven by the delivery pressure of the pump.

The presence of external control members makes such prior art pumps complex and relatively cumbersome.

It is an object of the present invention to provide a rotary positive displacement pump with variable displacement of the kind mentioned above, and a method of regulating the displacement of such a pump, which obviate the drawbacks of the prior art.

DESCRIPTION OF THE INVENTION

According to the invention, this is obtained in that the stator ring is configured as a multistage rotary piston for displacement regulation, arranged to be directly driven by a fluid under pressure, in particular fluid taken from a delivery side of the pump or from members utilising the pumped fluid.

Preferably, a pair of stages of the piston are formed by a pair of external radial appendages of the ring: the first appendage is permanently exposed to the action of the fluid under pressure, in order to keep the pump displacement at a first value, determined through a suitable calibration of members opposing the rotation, whereas the second appendage is arranged to be exposed to the action of the fluid under pressure upon an external command, jointly with the first appendage, in order to bring the pump displacement to a second value, different from the first one .

Advantageously, the ring has at least one annular cavity, which houses a partition member rigidly connected to the body and is arranged to receive the fluid under pressure between the partition member and one end of the cavity itself, in order to increase a thrust surface onto which the fluid acts for the regulation, or in order to form a further stage of the rotary piston.

Advantageously, at least one piston stage may have an actuating surface, onto which the fluid under pressure acts, having an area which changes during the piston rotation.

The invention also implements a method of regulating the displacement of a rotary positive displacement pump by means of the rotation of an eccentric stator ring inside which the pump rotor rotates, the method comprising the steps of:

- configuring the ring as a multistage rotary piston; and
- directly driving the piston rotation by means of a fluid under pressure.

Advantageously, this second step includes at least:

- applying the fluid to a first stage of the piston in order to maintain the displacement, in steady state conditions, at a first value determined through a suitable calibration of members opposing the rotation; and
- applying the fluid to a second stage of the piston, simultaneously with the application to the first stage and upon an external command, in order to bring the displacement to a second value different from the first one.

According to a further aspect of the invention, there is also provided a lubrication system for a motor vehicle engine, in which the adjustable displacement pump and the method of regulating the displacement set forth above are employed.

BRIEF DESCRIPTION OF THE FIGURES

Further features and advantages of the invention will become apparent from the following description of preferred embodiments, given by way of non limiting examples with reference to the accompanying drawings, in which.

DESCRIPTION OF PREFERRED EMBODIMENTS

Figure 1:
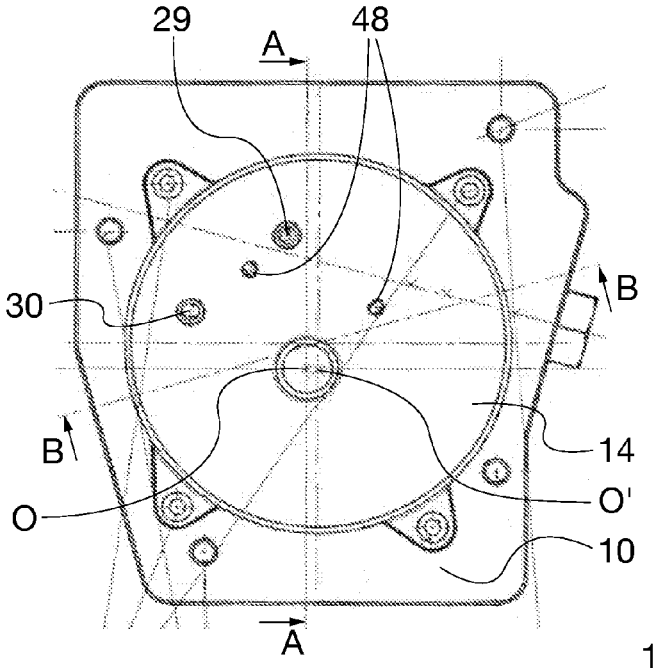
FIG. 1 is a front view of a pump according to the invention.

Referring to FIGS. 1 to 5, a pump according to the invention, generally denoted by reference numeral 1, includes a body 10 having a cavity 11 with substantially circular cross-section in which a movable ring 12 (stator ring) is located. The latter in turn has a cavity 13, also with substantially circular cross-section, eccentrically arranged relative to cavity 11 and having a centre 0'. In the illustrated example, cavities 11 and 13 are blind cavities and are closed by a cover 14. In accordance with other embodiments, the cavities could be through cavities, closed by two suitably aligned covers, as it can be readily understood by a person skilled in the art.

Cavity 13 in turn houses a rotor 15, rigidly connected to a driving shaft 15*a* making it rotate about a centre O, for instance in clockwise direction, as shown by arrow F. Rotor 15 has a set of vanes 16, radially slidable in respective radial slots. At an outer end, vanes 16 are at a minimum distance from side surface 13*a* of cavity 13, whereas at the inner end they rest on guiding or centring rings 17, mounted at the axial ends of rotor 15 and arranged to maintain the minimum distance between vanes 16 and surface 13*a* in any condition of eccentricity. As it is typical for such pumps, and as it will be better described later on, stator ring 12 may be made to rotate by a certain angle from a maximum displacement position (shown in FIG. 2 and taken also in rest conditions of the pump), in which centres O and O' are mutually spaced apart and the rotor is substantially tangent to surface 13*a*, and a minimum displacement position (shown in FIG. 3), in which the centres of rotor 15 and cavity 13 are coaxial or substantially coaxial.

In the present description, the term "coaxial or substantially coaxial" is used to denote a minimum distance, tending to 0, between centres O and O'.

A suction chamber 18, communicating with a suction duct 20, and a delivery chamber 19, communicating with a delivery duct 21, are defined between rotor 15 and surface 13*a*. Such chambers are substantially diametrically opposite.

Ring 12 acts as a multistage rotating piston for displacement regulation and, to this aim, it has on its external surface a pair of radial appendages 23, 24 (which, in the illustrated exemplary embodiment are integral parts of ring 12), which project into respective chambers 25, 26 defined by ring 12 and by respective recesses in the side surface of cavity 11 and slide onto bases 25*a*, 26*a* of chambers 25, 26, respectively. In the region where they are in contact with the base of the respective chamber, appendages 23, 24 may be equipped with gaskets 27, 28, respectively, for optimising the hydraulic seal.

One of chambers 25, 26 is permanently connected to the delivery side of the pump or to the members utilising the pumped fluid (in particular, in the preferred application, to a point of the lubrication circuit located downstream the oil filter), through a first regulation duct, not shown in these Figures, ending into an inlet passage 29 or 30, respectively, of the chamber. By means of a valve operated by the electronic control unit of the vehicle, the other chamber can in turn be put in communication with the delivery side of the pump or with the members utilising the pumped fluid through a second regulation duct ending into an inlet passage 30 or 29 of the chamber. Also the valve and the second regulation duct are not shown in these Figures.

Both appendages 23, 24 are therefore exposed to the fluid pressure conditions existing at the delivery side and/or in the utilisation members and they form a first stage of displacement regulation and a second stage of displacement regulation, respectively, the second stage operating jointly with the first stage, as it will be better explained in the description of the operation. The radial sizes and the circumferential amplitudes of chambers 25, 26 will be determined by the operation characteristics required of the pump. Chambers 25, 26 can also be defined as regulation cylinders, and appendages 23, 24 form the corresponding pistons. One of the appendages (appendage 24 in the drawing) may be provided with projections 24*a*, 24*b* acting as stops in the rest position and in the operating condition, respectively, and keeping the appendage spaced apart from the adjacent end wall of chamber 26 at the end of the ring stroke.

Both chambers are equipped with drainage ducts 31, 32 for discharging oil seepages, if any, and for compensating the volume variation generated when ring 12 is made to rotate. If necessary, screws 48 for adjusting the drainage flow are provided in cover 14 in order to damp possible hydraulic pulsations of the displacement regulating system.

In the illustrated embodiment, drains 31, 32 communicate with the outside. In other embodiments, drains 31, 32 are for instance connected to the suction chamber.

Stator ring 12 further has lightening cavities (two cavities, denoted 38, 39, in the illustrated example), one of which (cavity 38 in the example) is formed in correspondence of the region where appendages 23, 24 are provided. At least cavity 38 may be divided into a forward chamber (with reference to the rotation direction) 38*a* and a backward chamber 38*b* by a barrier 40, which is rigidly connected to body 10, to which it is fastened for instance by means of a pin 41. During the rotation of ring 12, the barrier engages in fluid-tight manner the diametrically opposite walls of cavity 38 by means of gaskets 50. Cavity 38, at least in its section concerned by the sliding on barrier 40, if any, has substantially the shape of an arc of an annulus concentric with chamber 11.

If barrier 40 is provided, one of chambers 38*a*, 38*b* (chamber 38*a* in the illustrated example) is connected to one of chambers 25, 26 (chamber 25 in the illustrated example) through a duct 42 formed in the corresponding appendage (appendage 23 in the example) and hence it too is fed with oil under pressure. Advantageously, such a configuration allows adding the thrust areas on appendage 23 or 24 and on the end wall of cavity 38 while keeping the pump size limited.

Chamber 38*b* is instead equipped with a drainage duct 44, connected to the suction chamber in the illustrated example, which has functions similar to drainage ducts 31, 32. In other embodiments, drainage duct 44 may be connected to the outside of the pump, in similar manner to drainage ducts 31, 32.

In body 10 there is further formed a seat 33 for a member 34 opposing the rotation of ring 12, for instance a helical spring preloaded so as to prevent the rotation of the ring as long as the pressure applied to appendage 23 (or the overall pressure applied to the different stages of the rotating piston) is lower than a predetermined threshold, and to subsequently keep the pump displacement at the value corresponding to the pressure threshold. Spring 34 abuts on the one side onto a plug 35 closing seat 33, and on the other side it is wound on a ferrule or tappet 36 of which the base is connected to ring 12, in particular to the surface of an abutment or tooth 37 formed in the external surface of the ring itself, through an articulated joint, e.g. a spherical joint 47. The provision of the articulated joint allows keeping the spring ends parallel to each other, thereby ensuring a good lateral stability of the spring and minimising the variations of the torque applied by the spring onto the ring, as it will be described in detail later on.

The drawing further shows that delivery chamber 19 is connected, through a passage 45, with a circumferential chamber 46 defined between ring 12 and body 10. As it is apparent for the skilled in the art, this allows counterbalancing the radial thrusts exerted on ring 12 and generated by the hydraulic pressure acting on the arc of wall 13*a* corresponding to said chamber.

Eccentric ring 12, as well as centring rings 17, rotor 15 and barrier 40, are preferably formed by a process of metal powder sintering, or by moulding thermoplastic or thermosetting materials, with possible suitable finishing operations on some functional parts, according to the dictates of the art. More particularly, the combination of centring rings made of plastic material with vanes and a stator ring made of steel (sintered or pressed steel) would ensure a reduction of the radial clearance between the vanes and the stator as the temperature increases, with a consequent improvement in the volumetric efficiency of the pump.

Figure 6:
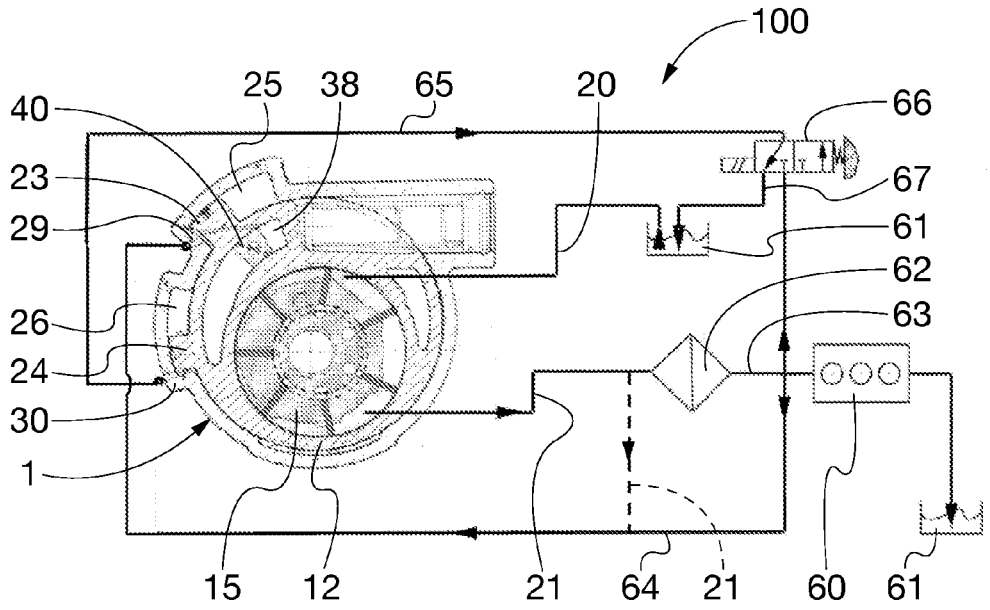
FIGS. 6 and 7 are diagrams of a lubrication circuit of a motor vehicle engine using the pump according to the invention, relative to the maximum displacement and minimum displacement condition, respectively.
Figure 7:
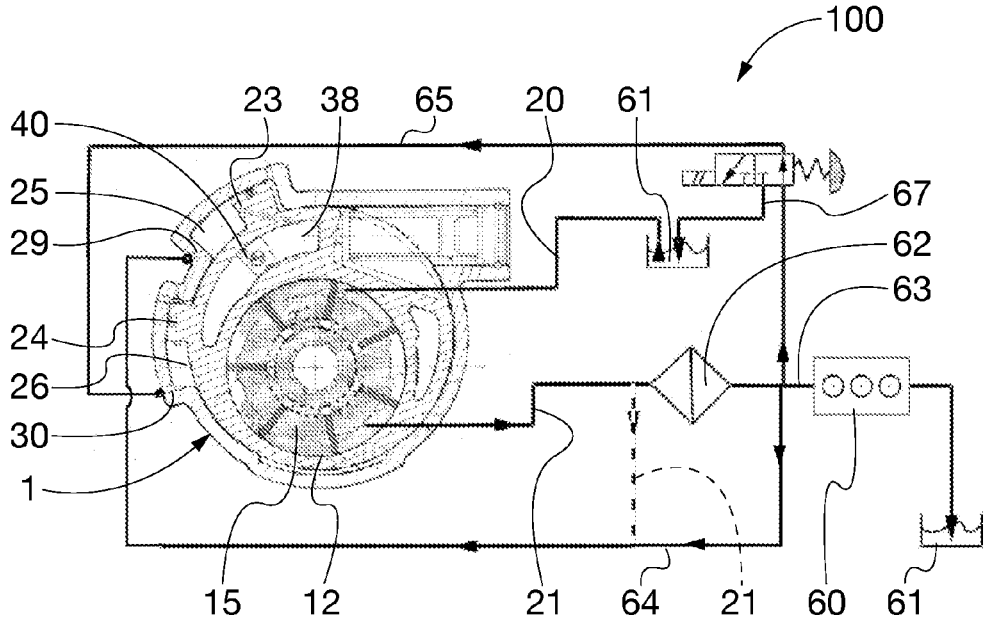

Turning to FIGS. 6 and 7, lubrication circuit 100 of a motor vehicle engine 60 using pump 1 is shown. Reference numerals 61 and 62 denote the oil sump and the oil filter, connected in conventional manner to suction and delivery ducts 20, 21 (FIGS. 4, 5) through ducts denoted by the same reference numerals, and reference numeral 63 denotes the outlet duct of filter 62, conveying the oil to engine 60. A first branch of outlet 63 of oil filter 62 (or a branch of delivery duct 21) forms the first regulation duct 64, which, in the illustrated example, conveys the oil to chamber 25. A second branch of outlet 63 of oil filter 62 forms the second regulation duct 64, in which valve 66 controlled by the electronic control unit, for instance an electromagnetic valve, is connected. Depending on the position of such a valve, oil leaving filter 62 may be conveyed to chamber 26 or intercepted: in the latter case, the oil present in chamber 26 and in duct 65 may be sent back to oil sump 61 through valve 66 and duct 67.

It is pointed out that the choice of connecting chamber 25 to delivery duct 21 (as partly shown by a dashed line) or, in the alternative, to outlet 63 of the oil filter, depends on the requirements of the engine manufacturer. However, the connection to the filter outlet is the choice ensuring the greatest stability in the regulation pressure since, as known, due to the nature of the positive displacement pumps, the delivery pressure has surges which are damped by filter 62. Moreover, as a skilled in the art will readily appreciate, the displacement regulation is independent of any pressure drop caused by the filter, for instance due to the greater or smaller clogging thereof because of impurities, or due to changes in oil viscosity.

Moreover, valve 66 might be housed in body 10 of pump 1, in which case ducts 64, 65 will be passages formed in said body.

The operation of pump 1 is as follows.

Figure 2:
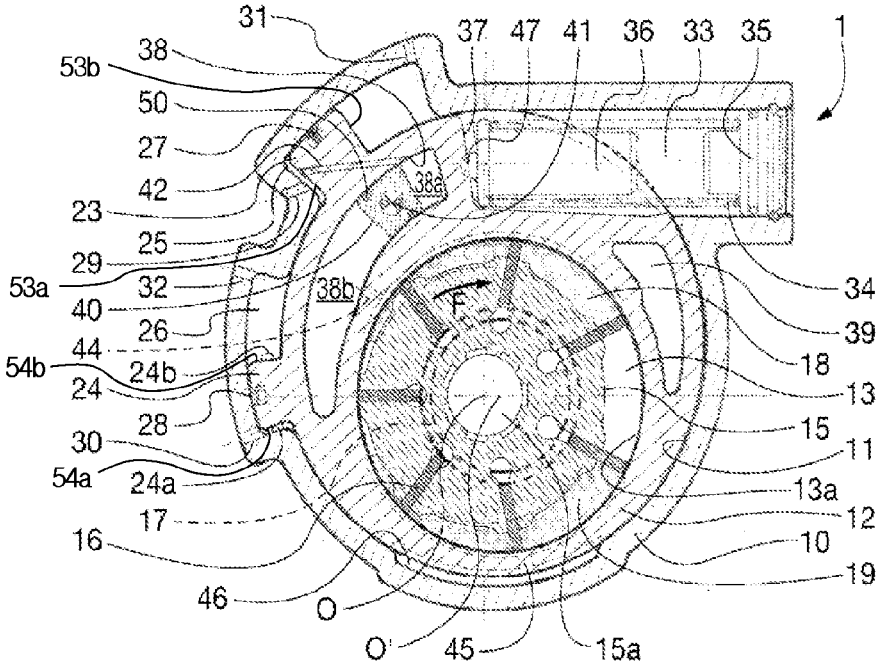
FIG. 2 is a plan view of the pump, from which the cover has been removed, in the maximum displacement condition.

Under rest conditions, the pump is in the condition shown in FIG. 2. As said, centre of rotation O of rotor 15 is offset relative to centre O' of cavity 13 of eccentric ring 12 and rotor 15 is located close to wall 13*a* of cavity 13. When pump 1 is started, the clockwise rotation of rotor 15 will give rise to an oil flow through chamber 19 and the associated delivery duct 21 and, at the same time, an equal volume of oil will be sucked from chamber 18 and the associated suction duct 20. As the rotation speed and the flow rate increase, the lubrication system of the engine, by opposing an increasing resistance to the flow, will make the pressure increase.

The delivery pressure (or the pressure downstream oil filter 62) is brought to chamber 25 through duct 64 and it will act on appendage 23, thereby creating a hydraulic thrust on ring 12 and generating a rotation torque. In case also barrier 40 is provided, the pressure in chamber 25 will be fed also to chamber 38*a* through duct 42, thereby generating a second torque against the reaction of barrier 40, which torque will add to the one applied to piston 23. Once the calibration value of the counteracting spring 34 has been attained, such a torque (or such torques in their whole) will cause a rotation of eccentric ring 12, in this case in clockwise direction, thereby proportionally reducing the distance between centres O and O' and consequently the pump displacement, and stabilising the pressure at the calibration value. As parameters such as the speed, the oil fluidity/temperature, the engine "permeability" (intended as the amount of oil used by the engine) and so on change, such a pressure will be maintained and controlled through the variation of the eccentricity and hence of the displacement.

When, as a function of the different operating parameters of the engine, as detected by the electronic control unit of the vehicle, it is desired to operate at a lower pressure value, with a consequent reduction in the absorbed power, fluid under pressure can be fed also to chamber 26 by means of valve 66, whereby a supplementary hydraulic thrust concordant with the thrust exerted on piston 23 is created on piston 24. In this way, the rotation torque of the piston is increased and the pump displacement is reduced. Stopping the feed to chamber 26 will bring the pressure back to the previous higher value through the variation of the displacement.

Figure 3:
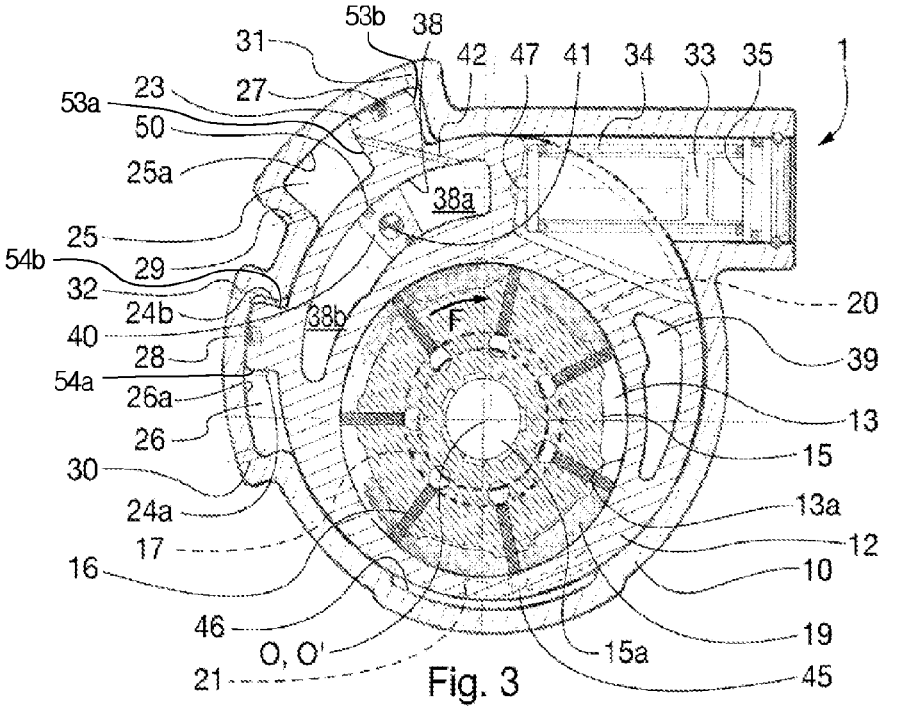
FIG. 3 is a view similar to FIG. 2, in the minimum displacement condition.

The rotation of stator ring 12 may continue until the position shown in FIG. 3 is attained, where projection 24*b* of piston 24 is in contact with the wall of chamber 26, centres O and O' coincide and vanes 16 and centring rings 17 rotate with the rotor without changes in their radial relative position. Consequently, the displacement is null and the pump is in stall condition. It is to be appreciated that this position may be taken when a hydraulic lock of the delivery pressure is approaching. In the constructional practice, a minimum displacement is preferably maintained by protecting the pump with a maximum pressure valve.

By mutually exchanging the drains and the oil inlets to chambers 25, 26, 38, it is also possible to generate one or more torques adding to the resistant torque generated by spring 34.

Figure 8:
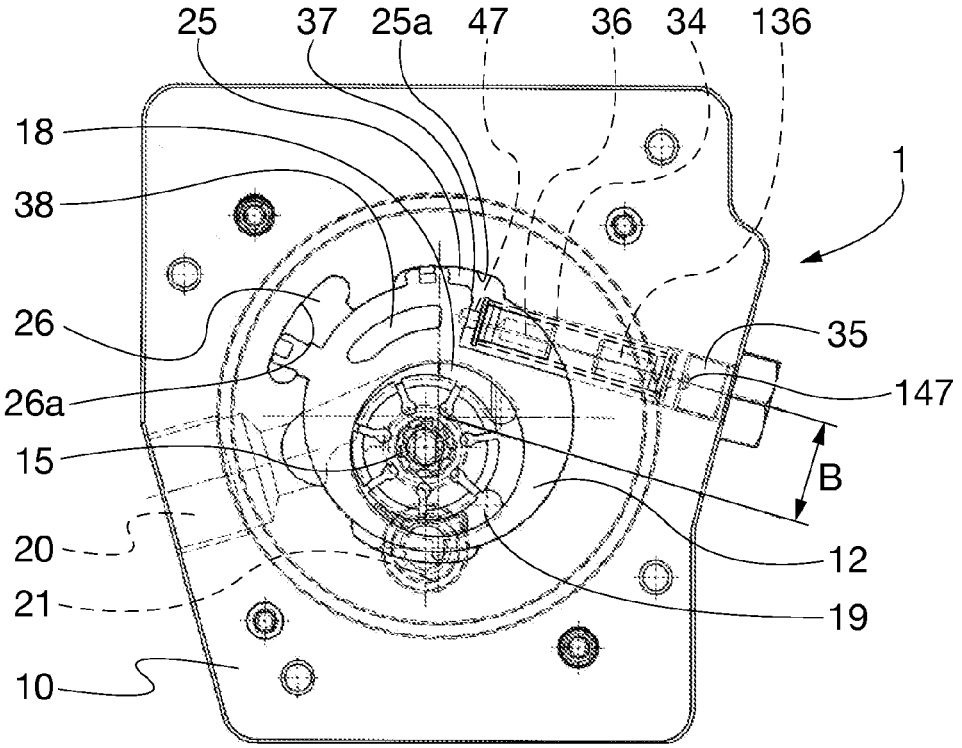
FIGS. 8 and 9 are simplified plan view showing a variant of the means opposing the ring rotation, in the maximum and minimum displacement condition of the pump, respectively.
Figure 9:
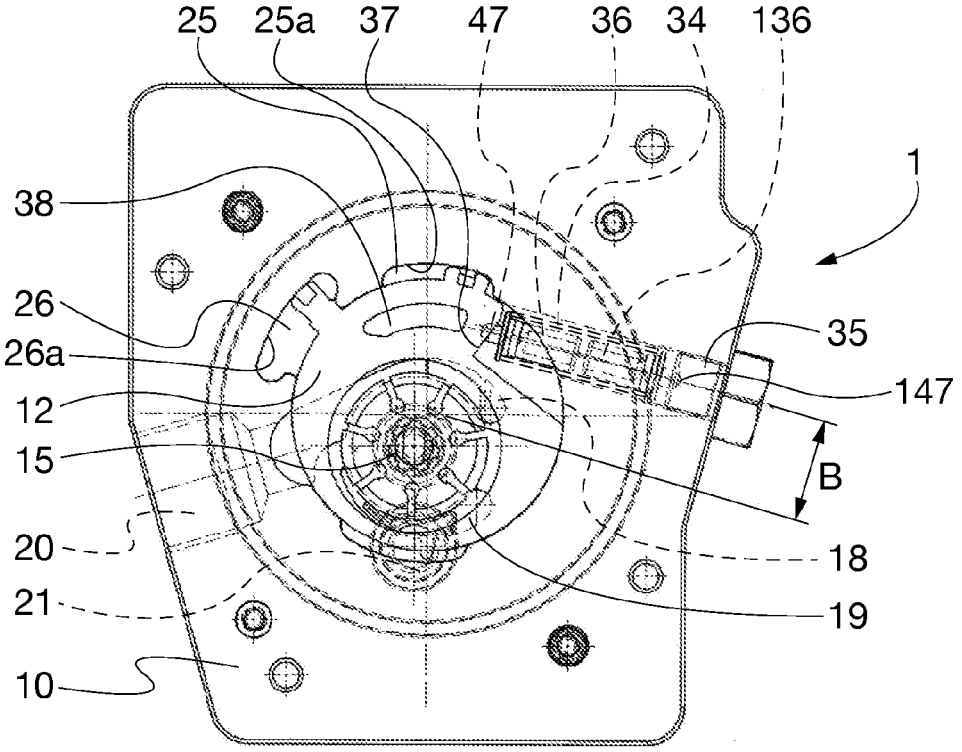

FIGS. 8 and 9 show a variant of the means opposing the rotation of ring 12. According to this variant, on the inner surface of plug 35 there is provided a second ferrule 136 onto which spring 34 is wound and the base of which is connected to the surface of plug 35 through a respective articulated joint, e.g. a spherical joint 147. This solution with a double articulated joint makes arm B of spring 34 (intended as the distance of the spring axis from the centre of ring 12) change as the position of eccentric ring 12 varies, and assists in making the response moment of the spring itself linear.

In such a variant, a single lightening cavity 38 is shown, which has no fixed barrier. Moreover, in the maximum displacement position, the recess or notch giving rise to abutment 37 onto which joint 47 is articulated communicates with the forward portion of chamber 25. FIGS. 8 and 9 also show a different shape of chamber 26 which is better suited to certain working processes for body 10 and makes projections 24*a*, 24*b* useless.

Figure 10:
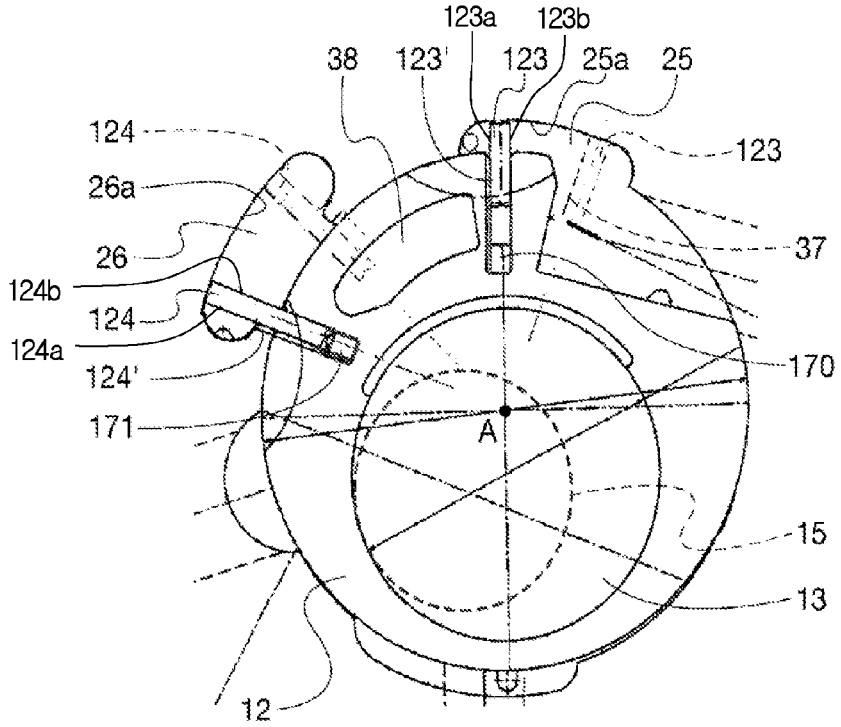
FIG. 10 is a simplified plan view showing a variant of the stator ring.

FIG. 10 shows another variant in which the displacement regulating pistons, instead of being integral parts of ring 12, consist of radial appendages or vanes 123, 124, received in respective slots 123', 124' and sliding in fluid-tight manner against bases 25*a*, 26*a* of chambers 25, 26 thanks to the thrust of suitable resilient means 170, 171, for instance spiral or leaf springs. The vanes are shown in solid lines in the positions they take under maximum displacement conditions of the pump and in dashed lines in the positions they take under minimum displacement conditions of the pump. In this Figure, the components that are not concerned by the changes in the regulation pistons have been omitted for the sake of simplicity, and only the trace of rotor 15 is indicated. Moreover, the axis of rotation of ring 12 is shown at A. Also this Figure shows a single lightening cavity 38 without barrier 40 and the different shape of chamber 26.

In the embodiments described above, bases 25*a*, 26*a* of chambers 25, 26, when viewed in plan, are arcs of circumference the centre of which is located on rotation axis A of ring 12, and chambers 25, 26 have constant radial sizes. This entails that the different stages or pistons have actuating surfaces 53*a*, 54*a*, or, alternatively, 53*b*, 54*b*, on which the fluid under pressure acts, having constant areas and therefore generate a torque that is proportional to the pressure of the actuating fluid and is constant over the whole rotation of ring 12.

Figure 11:
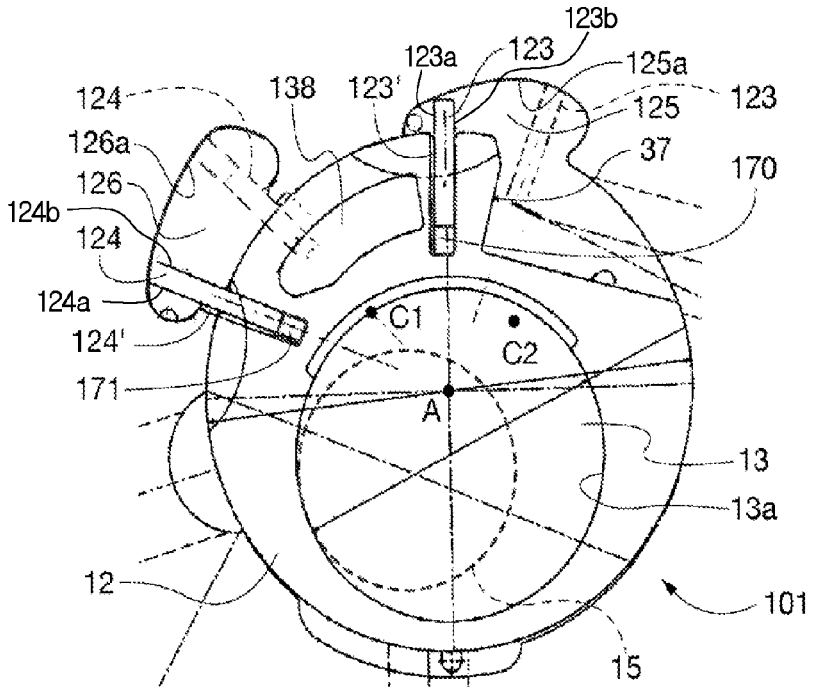
FIG. 11 is a view similar to FIG. 10, showing another variant of the stator ring.

FIG. 11 shows an embodiment in which the torque applied to ring 12 may be changed during the displacement regulation in order to take into account possible changes in the resistant torques encountered during such a regulation, for instance due to changes in the resistance opposed by opposing spring 34 and/or in the rotation frictions.

In the pump according to this embodiment, denoted 101, the displacement regulation pistons consist of slidable radial vanes 123, 124 urged by resilient means 170, 171, like in the embodiment shown in FIG. 10. Yet, bases 125*a*, 126*a* of chambers 125, 126, when viewed in plan, are shaped as arcs of circumferences of which centres C1, C2 do not coincide with centre of rotation A of stator ring 12. The same chambers have therefore variable radial sizes (in particular, in the Figure, radial sizes steadily increasing in the direction of the rotation performed by ring 12 for moving from the maximum displacement position to the minimum displacement position). The arcs forming bases 125*a*, 126*a* may possibly have different radiuses. It is also possible that only one chamber (in particular, the chamber in which the stage permanently exposed to the fluid pressure moves, for instance chamber 125) has a variable radial size. The skilled in the art will have no problem in designing and sizing vanes 123, 124 and resilient elements 170, 171 so as to ensure the contact between the vanes and bases 125*a*, 126*a* of chambers 125, 126 along the whole of the arc of rotation of ring 12.

The solutions shown in FIGS. 8 to 10 in respect of lightening cavity 38, the recess or notch giving rise to abutment 37 and the shape of chamber 26 are adopted also in this embodiment.

The operation of such a variant embodiment is similar to that described above. Considering vane 123, the only difference is that, during the rotation, due to the lack of concentricity of wall 125*a* with respect to ring 12 and hence to the increasing radial size of chamber 125, vane 123 will progressively come out from slot 123', whereby its actuating surface 123*a* or, alternatively, 123*b* (and of course its thrust area) and consequently the rotation torque applied to ring 12 progressively increase. This allows compensating, for instance, the increase in the resistant torque caused by the increase in the force exerted by reaction spring 34 and/or by the rotation frictions.

The invention actually attains the desired aims. By configuring the stator ring as a multistage rotary piston to which the pressure of the control fluid is directly applied, external driving units are eliminated, and hence the structure is simpler and therefore less expensive and less prone to failures, as well as less cumbersome.

It is clear that the above description has been given only by way of non-limiting example and that changes and modifications are possible without departing from the scope of the invention.

Figure 4:
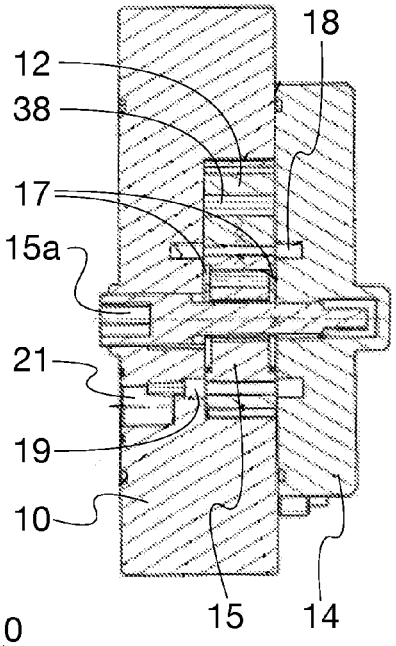
FIGS. 4 and 5 are axial cross-sectional views taken according to planes passing through lines A-A and B-B in FIG. 1, respectively.
Figure 5:
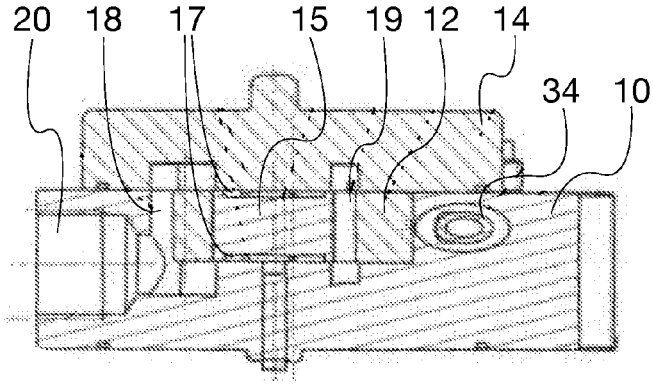

For instance, in FIGS. 3 and 4 it has been assumed that lightening cavity 38, in case barrier 40 is provided, is connected to one of chambers 25, 26 and receives the oil under pressure jointly with said chamber. In the alternative, it is possible to feed cavity 38 with the oil coming from delivery duct 21 or from outlet 63 of oil filter 62 in a manner independent from chamber 25 or 26, so that cavity 38 ad barrier 40 act as a further regulation stage. The independent feed could be controlled through a valve similar to valve 66 (FIGS. 6, 7).

Of course, a barrier similar to barrier 40 and an independent feed with the oil coming from delivery duct 21 or from outlet 63 of oil filter 62 could be provided also for lightening cavity 39 and for further cavities, if any, formed in ring 12. Cavity 39 and the further cavities, if any, thus form in turn further regulation stages.

Moreover, even though FIG. 11 shows chambers 125, 126 with bases 125*a*, 126*a* consisting of arcs of circumferences arranged so that such chambers have progressively increasing radial sizes in the direction of the rotation of ring 12 from the maximum displacement position to the minimum displacement position, it is also possible that the radial sizes of the chambers progressively decrease, if the constructional or operating conditions demand a decrease in the torque exerted by vanes 123, 124 along the arc of rotation of ring 12. In both cases, bases 125*a*, 126*a* might have non uniform curvatures (however, curvatures such that the radial size of the respective chamber is in the whole increasing or decreasing), so that a discontinuous variation of the active areas of vanes 123, 124, and hence a discontinuously varying torque along the arc of rotation of ring 12, may be obtained. Of course, at the discontinuity regions, the bases must be shaped so as to allow vane rotation in both directions.

Still in the embodiment shown in FIG. 11, if cavity 38 and possible further lightening cavities are provided with a barrier similar to barrier 40 (FIGS. 2 and 3) and are configured so as to give rise to further regulation stages, also such stages may have actuating surfaces with variable areas.

Lastly, even if the invention has been disclosed in detail with reference to a pump for the lubrication oil of a motor vehicle engine, it can be applied to any positive displacement pump for conveying fluid from a first to a second working environment, in which a delivery rate reduction as the pump speed increases is convenient.

The invention claimed is:

1. A variable displacement rotary positive displacement pump for fluids, comprising a pump body, a stator ring, a rotor arranged to rotate within an eccentric cavity of the stator ring, a suction chamber and a delivery chamber, said suction chamber and said delivery chamber being defined between the stator ring and the rotor, wherein the stator ring is arranged to be rotated within a predetermined angular interval, as operating conditions of the pump vary, in order to vary a relative eccentricity between the eccentric cavity and the rotor and hence the displacement of the pump, wherein the stator ring is configured as a multistage rotary piston for displacement regulation and arranged to rotate about an axis internal to the stator ring and comprising a first and a second radial appendage which define, respectively, a first and a second stage of the rotary piston, each of said first and second radial appendage having a respective first and second actuating surface, said first appendage projecting into a first stage chamber and said second appendage projecting into a second stage chamber;

wherein each of said first and second stage chamber is defined between the stator ring and the pump body and comprises an inlet passage and a drainage passage, connecting the respective stage chamber with the outside of the pump; and wherein the first and second radial appendage are arranged to be directly driven by a fluid under pressure reaching the first and second chamber through either said inlet passages or said drainage passages, so that the fluid under pressure can act, selectively and independently, on either the first or the second actuating surface of the first radial appendage and on either the first or the second actuating surface of the second radial appendage.

2. The pump as claimed in claim 1, wherein the first and the second radial appendages of the stator ring, are slidable in fluid-tight manner against bases of the first and the second stage chambers, respectively, the first radial appendage being permanently exposed, in use, to the fluid under pressure, and the second radial appendage being arranged to be exposed to the fluid under pressure upon a command external to the pump, jointly with the first radial appendage.

3. The pump as claimed in claim 1, comprising an opposing member which opposes the rotation of the stator ring, said opposing member is located between the stator ring and an element rigidly connected to the pump body and is connected through a first articulated joint to the stator ring or is connected through the first articulated joint and a second articulated joint to the stator ring and to the element rigidly connected to the pump body, respectively.

4. The pump as claimed in claim 2, wherein a chamber for balancing pressures generated onto the rotor during pump operation is provided between the stator ring and the pump body.

5. The pump as claimed in claim 2, wherein the pump is a pump for a lubrication circuit of a motor vehicle engine and the fluid under pressure is oil taken from the delivery chamber of the pump or from a point of the lubrication circuit located downstream an oil filter.

6. The pump as claimed in claim 1, wherein the stator ring has at least one annular cavity, which houses a partition member rigidly connected to the pump body and is arranged to receive the fluid under pressure between the partition member and one end of the annular cavity itself either jointly with one of the first or second stage chambers, in order to increase a thrust surface, or in independent manner, in order to form a further regulation stage of the rotary piston.

7. The pump as claimed in claim 1, comprising an opposing member which opposes the rotation of the stator ring, said opposing member is located between the stator ring and an element rigidly connected to the pump body and is connected through a first articulated joint to the stator ring or is connected through the first articulated joint and a second articulated joint to the stator ring and to the element rigidly connected to the pump body, respectively.

8. The pump as claimed in claim 7, wherein the first and second stage chambers are arranged to receive the fluid under pressure through either the inlet passages or the drainage passages in such a way that the fluid under pressure applies to the stator ring a thrust either opposing or concordant with a thrust applied by the opposing member.

9. The pump as claimed in claim 1, wherein a chamber for balancing pressures generated onto the rotor during pump operation is provided between the stator ring and the pump body.

10. The pump as claimed in claim 1, wherein at least one stage of the rotary piston has an actuating surface, exposed to the action of the fluid under pressure, having an area varying as the position of the piston varies, and is arranged to slide in fluid-tight manner against the base of a chamber defined between the ring and a body of the pump and having a variable radial size that progressively increases or decreases in the rotation direction of the ring leading to a decrease in the pump displacement.

11. The pump as claimed in claim 10, wherein all of the radial appendages of said multistage rotary piston have actuating surfaces with variable areas.

12. The pump as claimed in claim 2, wherein at least one of the first and second radial appendages of the multistage rotary piston is a radial vane slidingly received in a respective slot of the rotary piston so that the actuating surface of said at least one radial appendage has areas varying as the position of the rotary piston varies, the radial vane being arranged to slide in fluid- tight manner against the base of a respective stage chamber which is defined between the stator ring and the pump body and which has a variable radial size that progressively increases or decreases in the rotation direction of the stator ring leading to a decrease in the pump displacement.

13. The pump as claimed in claim 1, wherein the pump is a pump for a lubrication circuit of a motor vehicle engine and the fluid under pressure is oil taken from the delivery chamber of the pump or from a point of the lubrication circuit located downstream an oil filter.

14. A lubrication system for an engine of a motor vehicle, comprising a pump as claimed in claims 1.

15. The pump as claimed in claim 1, wherein the axis passes through the cavity of the stator ring.

* * * * *